United States Patent [19]

Tapfer

[11] Patent Number: 4,589,520

[45] Date of Patent: May 20, 1986

[54] PLATFORM SERVICE VEHICLE

[76] Inventor: David L. Tapfer, P.O. Box 250, 1680 Bellus Rd., Hinckley, Ohio 44233

[21] Appl. No.: 456,313

[22] Filed: Jan. 6, 1983

[51] Int. Cl.[4] ..... E04G 1/22

[52] U.S. Cl. ..... 182/63; 182/46

[58] Field of Search ..... 182/148, 63, 2, 46, 182/141, 62.5

[56] References Cited

U.S. PATENT DOCUMENTS

| | | | |
|---|---|---|---|
| 274,410 | 3/1883 | Terry | 182/63 |
| 274,977 | 4/1883 | Richards | 182/63 |
| 1,337,487 | 4/1920 | Schlatter | 182/63 |
| 1,718,979 | 7/1929 | Protzeller | 182/62.5 |
| 2,666,417 | 1/1954 | Harsch | 182/63 |
| 2,753,224 | 9/1950 | Troche et al. | 182/148 |
| 2,888,299 | 1/1953 | Balogh | 304/29 |
| 2,965,191 | 12/1960 | Balogh | 182/63 |
| 3,000,473 | 9/1961 | Reynolds | 182/63 |
| 3,031,027 | 4/1962 | Mitchell | 182/63 |
| 3,095,945 | 7/1963 | Mitchell | 182/63 |
| 3,224,528 | 10/1963 | Hubbard | 182/2 |
| 3,236,329 | 7/1962 | Price | 182/14 |
| 3,642,096 | 2/1972 | Valentine | 182/46 |
| 3,757,895 | 9/1973 | Knutson | 182/46 |
| 3,927,732 | 12/1975 | Ooka et al. | 182/36 |
| 3,958,376 | 5/1976 | Campbell | 182/63 |

*Primary Examiner*—Reinaldo P. Machado
*Assistant Examiner*—Alvin Chin-Shue
*Attorney, Agent, or Firm*—Woodrow W. Ban

[57] ABSTRACT

A platform type service vehicle or truck having an elevatable platform hydraulically rotatable through 360°, self locking as to rotation when not under power, with a single mast of telescoping sections comprising opposing channel-like members linked by crossmembers closely adjacent each end of each section. The sections are nested with a stationary section being outermost of the nest and the most elevatable innermost. The mast is mounted upon the frame members of the chassis of a truck and is tranportable over public highways with the platform in a lowered position to a point of use, whereupon the platform is elevated to a desired height for use.

7 Claims, 8 Drawing Figures

PLATFORM SERVICE VEHICLE

FIELD OF THE INVENTION

This invention relates to vehicles operable over public highways and having a work surface capable of being elevated from a lowered position atop a transporting vehicle to an elevated work position. Particularly, this invention relates to such vehicles having a platform mounted atop a vertically telescoping mast affixed to a truck chassis. More specifically, this invention relates to such vehicles wherein the platform is rotatable in a horizontal plane at least while the mast is vertically extended, and wherein rotation is accomplished through 360° in either a clockwise or counterclockwise direction.

BACKGROUND OF THE INVENTION

Vehicles providing an elevatable work surface, and particularly truck or truck-like vehicles capable of unrestricted operation over the public highways and providing such a work surface, find considerable utility in providing work stations for servicing public utility facilities, highway signs and signals, lights and the like as well as in constructing buildings, piping systems and the like. These vehicles generally can be divided into two general groupings depending upon the nature of the work surface provided.

In one grouping, the work surface is a bucket-like work surface generally capable of containing 1 or 2 men and a relatively limited quantity of tools, parts for installation and the like. Traditionally these buckets have been mounted upon a variety of vehicles in a variety of manners, but more recently have generally come to be mounted upon an elevatable boom, generally articulated, but from time to time of a telescoping nature, affixed to the chassis of a medium or heavy duty conventional truck. Generally, the booms are mounted to a pivotable chassis mounted turret rotatable throughout 360°, and provide a work station moveable both vertically and horizontally to a variety of heights and to a number of distances from the truck.

However, where a task to be performed requires that more than two men be elevated at a time, or where bulky, or a large quantity of materials are required at the elevated work site, these bucket-like work surfaces find some limitations. Additionally, since the bucket necessarily hangs away from the truck during most work functions, should the vehicle experience a failure limiting or eliminating motion of the bucket, egress for occupants of the bucket can be most difficult. Often, therefore, a two man crew is required for operating such vehicles, one remaining upon the ground in the event of mobility loss, even though the task occupying the vehicle requires only one man for safe completion. Often these telescoping boon trucks, partially due to the angle of the attachment between boom and turret, require a relatively low body profile. Enclosed storage space aboard the vehicle is thereby somewhat limited.

The other grouping of vehicles includes trucks having generally platforms elevated only vertically from the truck, reaching a work site positioned relatively directly above the truck. These platforms generally provide a relatively flat, spacious working area often including guard railings and/or other protective measures for restraining men working upon the platform from falling overboard. Often these platforms are considerably longer than wide and are oriented longitudinally with the truck during transportation along public highways. In some proposals these platforms have been partially rotatable when elevated for gaining some access to work located slightly to one side or the other of the truck. In one proposal the platform includes an extension slidingly received in the platform that may be used for extending the platform to reach work more remote from the truck.

With these platform service vehicles, at least two general limitations have, from time to time, performed to reduce their utility. One such limitation relates to stability. The platform being generally large and heavy when compared to the buckets used on other vehicles, a large force moment can be generated by the platform when fully elevated, making the work surface as carried upon the truck possibly unstable and therefore potentially unsafe. One proposal for stabilizing the work surface has been to mount the platform upon 4 tubular masts mounted in a generally rectangular pattern upon the truck each including a telescoping cylinder for elevating the platform and tubular mast. One difficulty with this proposal appears to have been to make mechanisms both for raising and for rotating the platform somewhat bulky and heavy, which can correspondingly reduce the load bearing capability of the platform. Another drawback with this proposal appears to have been to make such a vehicle less competitive from a cost aspect, the vehicle requiring 4 hydraulic lift cylinders and related equipment, 4 masts, and the like.

In another proposal, a single mast has been utilized, comprised of nested opposing channel members each set of opposing channel members being received outside of and being attached to parallel frame members of the truck chassis. With the platform fully extended, however, these nested channel members have tended to spread from an optimal alignment and todistort under torque applied by the elevated tower causing some difficulty in operation, particularly, where lower portions of such nested channel members comprising a mast for such a platform vehicle have not been securely joined by crossmembers.

In another general limitation, the extent of rotational mobility of the platform can impact upon its utility. In prior proposals, the platform has not been rotatable through 360° in either direction, that is clockwise or counterclockwise, occasionally necessitating turning the tower almost completely about simply to gain a small change in the rotational orientation of the platform. Such platforms were not freely rotatable, that is they could not be rotated to and locked into an infinite number of rotational positions, being generally restricted to being positively locked at about one or two dozen positions within the span of platform rotation. Additionally, such platforms generally were hand cranked for rotation, potentially a quite difficult undertaking where the truck is on other than a level surface.

In another general limitation the extent of electrical insulation of the work surface from the truck, and therefore the relative safety of the work surface near electrical wiring, has been limited to about 300 volts. While to some extent, the insulative capability of the work surface is related to the nature of insulators used to separate the work surface from the mast(s) and truck, in part it is related to the physical configuration of the platform and its interconnection to the mast(s).

In still another general limitation, platforms, while generally being raised under power, usually hydraulic, have been allowed to lower under the impetus of gravity. Gravity lowering, where telescoped mast members are slidingly interacting, can trigger an uneven lowering causing cocking and jamming of the mast mechanism. These difficulties can be aggrevated where the mast frame emebers have become distorted due to torque loading attributable to the presence of the platform atop the mast.

In still another general limitation, telescoping sections of the mast(s) have not been specifically tied to a particular section of a hydraulic cylinder utilized for raising the platform. As a result, from time to time less structurally efficient sections of a mast may have been telescoped preferentially due to binding between the sliding mast sections.

A platform service vehicle capable or self propelled transport over public highways, having a single telescoping mast bearing a platform that can be horizontally rotated through 360° either clockwise or counterclockwise and that can can be locked into an infinite number of rotational positions would find considerable utility. Where, further such a platform service truck can provide a work platform having an electrical insulating capability of 5000 volts or more as is often necessary to work upon modern electrical facilities, and where such a truck provides exceptionally smooth, reliable operation of the telescoping mast and rotating platform utilizing but a single motive power source, its utility could be substantial.

DISCLOSURE OF THE INVENTION

The present invention provides a platform service vehicle or truck suitable for use upon and travel along public highways. The truck includes a platform having a work surface, the platform being rotatable in a horizontal plane, and being mounted atop a single telescoping mast. The truck includes a chassis having parallel frame members, an engine and a drive train for powering the truck, and at least one powered source of hydraulic fluid under pressure for operating hydraulic devices mounted to the truck. The platform is capable of elevation from a lowered, travelling position to at least one elevated working position.

The platform is mounted atop a telescoping tower or mast that includes a stationary section mounted upon the chassis of the truck and a plurality of extendible, telescoping sections slidingly nested one within another so that the stationary section is outermost of the nest and a telescoping section more extendible that all the others is innermost of the nest. The tower sections are each comprised of two opposing channel-like generally U shaped vertical structural members at least thrice joined on each respective arm of the U one to the other by crossmembers, with a crossmember being positioned closely adjacent each end of each tower section. The tower sections include elevational stops positioned for restraining a tower section from being withdrawn from a next outermost tower section during telescopic extension of the mast.

A hydraulic cylinder is provided for extending and retracting the mast. The hydrauic cylinder is provided with an outer barrel or shell generally including an attachment base or attachment tabs of conventional form, and a number of telescoping cylinder portions extendible from the cylinder. The number of telescoping cylinder portions is equal to the number of extendible, telescoping tower sections utilized in the mast. A most extendible cylinder portion includes an attachment point. The cylinder is affixed by the attachment point to the truck adjacent the mounting between chassis and stationary tower section. The cylinder is affixed by its barrel, generally by its base or tabs, to the most extendible tower section. Fluid interconnections are provided between the cylinder and the powered source of hydraulic fluid.

The platform is affixed for rotation in a horizontal plane atop the most extendible tower section. The platform includes electrical insulators rated for at least 500 volts, an upper base including a work surface, and a lower base that is electrically insulated from the upper base and work surface. The electrical insulative separation is effected by interposition of the insulators between the base and by arrangement of the bases and any drive means for rotation of the platform so as to provide an electrical separation rated for at least 500 volts.

The truck includes a hydraulic drive means for rotating the platform upon the mask, the hydraulic drive means interconnecting the uppermost mast tower section and the platform. The hydraulic drive means is self locking for rotational movement of the platform when the drive means is not engaged in rotatingly driving the platform and is capable of locking rotation at an infinite number of positions about the rotational circle of the platform. The hydraulic drive means can drive the platform for rotation in either direction, that is clockwise or counterclockwise.

At least one set of controls is provided for regulating the flow of hydraulic fluid supplied to the cylinder and the rotational drive means. Where controls are to be mounted above the lower base, they are interconnected so as to preserve the electrical insulative integrity of the platform, and particularly the work surface and a duplicate set of controls capable of overriding those mounted above the lower base is provided. Optionally, a set of manual valves can also be provided for emergency control of hydraulic fluid flows.

Preferably, the platform is provided to be rated as electrically insulatingly separated from the truck and the ground by at least 5000 volts. The platform work surface is fabricated from a laminate of wood and fiberglas or from fiberglas alone. The platform rotates at a speed of up to 3 revolutions per minute (rpm) with preferred rotational rates not exceeding 1 rpm.

The platform preferably includes safety rails and a toe plate surrounding the platform and conforming with applicable safety regulations. Most preferably these rails are arranged so as to be hinged between a lowered travelling position while the truck is transported along a public highway or the like, and a raised work position for protecting workmen while the platform is elevated and in use.

Where a set of controls are to be mounted upon the platform, preferably, the controls are of the type providing a fluid signal, whether pneumatic or hydraulic through electrically nonconductive tubing to a fluid to electric signal converter mounted at least below the upper base whereby the signal from the platform is converted to an electrical control signal. Preferable any control signals originating from the platform are arranged for transmission to the truck through a rotating coupling.

The above and other features and advantages of the invention will become more apparent when considered in light of the drawings and a description of a preferred embodiment of the invention which follow, together forming a portion of the specification.

BEST EMBODIMENT OF THE INVENTION

Figure 1:
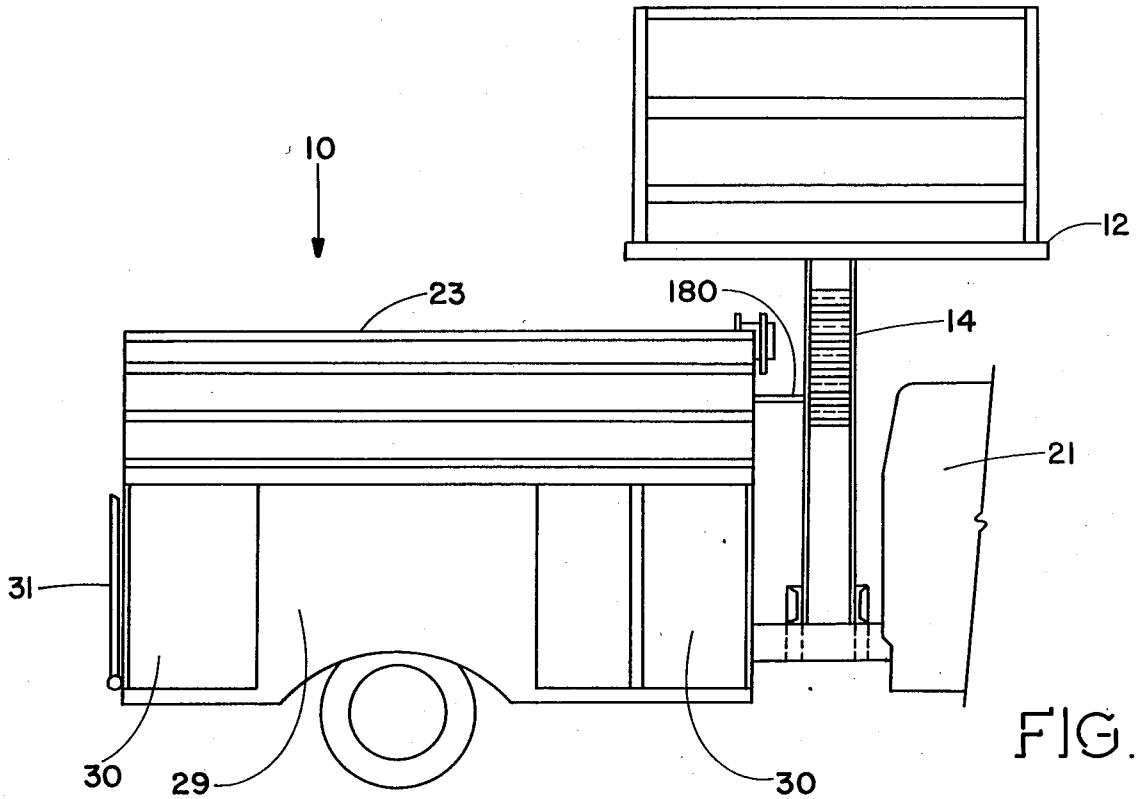
FIG. 1 is an overview representation of a platform sevice truck made in accordance with the instant invention.

Referring to the drawings, a Platform Service Truck 10, or vehicle is shown in FIG. 1 The truck 10 includes a platform 12, and a mast 14 for elevating the platform. The platform 12 is rotatable upon the mast 14.

The truck 10 also includes a cab 21, a body 23, and as shown best in FIG. 2, a chassis 25 including parallel frame members 27 spaced one from the other and extending longitudinally beneath the truck. The cab can be of any suitable or conventional nature and generally is mounted to the chassis, typically housing or sitting above an engine and transmission (not shown).

The truck also typically includes a utility box 29 mounted to the chassis, generally longitudinally aft of the cab 21. The box 29 can be of any suitable or conventional nature, but frequently includes lockable storage bins or cabinets 30 for storing tools, supplies and the like. From time to time the box may include a hydraulically powered lifting tail gate 31 by which bulky and heavy objects may be placed into the box.

Figure 2A:
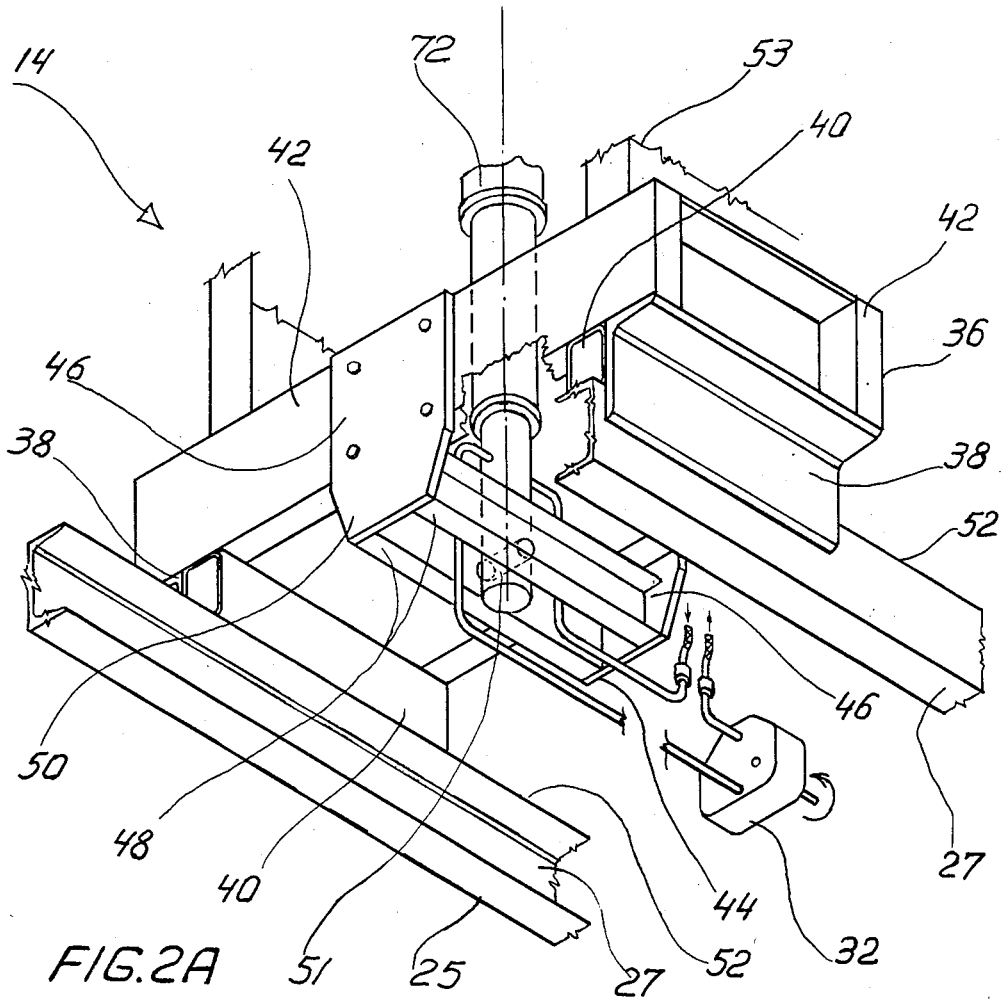
FIG. 2*a* is an isometric view from below of a portion of the chassis of a platform service truck and the mounting of a mast to the chassis in accordance with the instant invention.
Figure 2B:
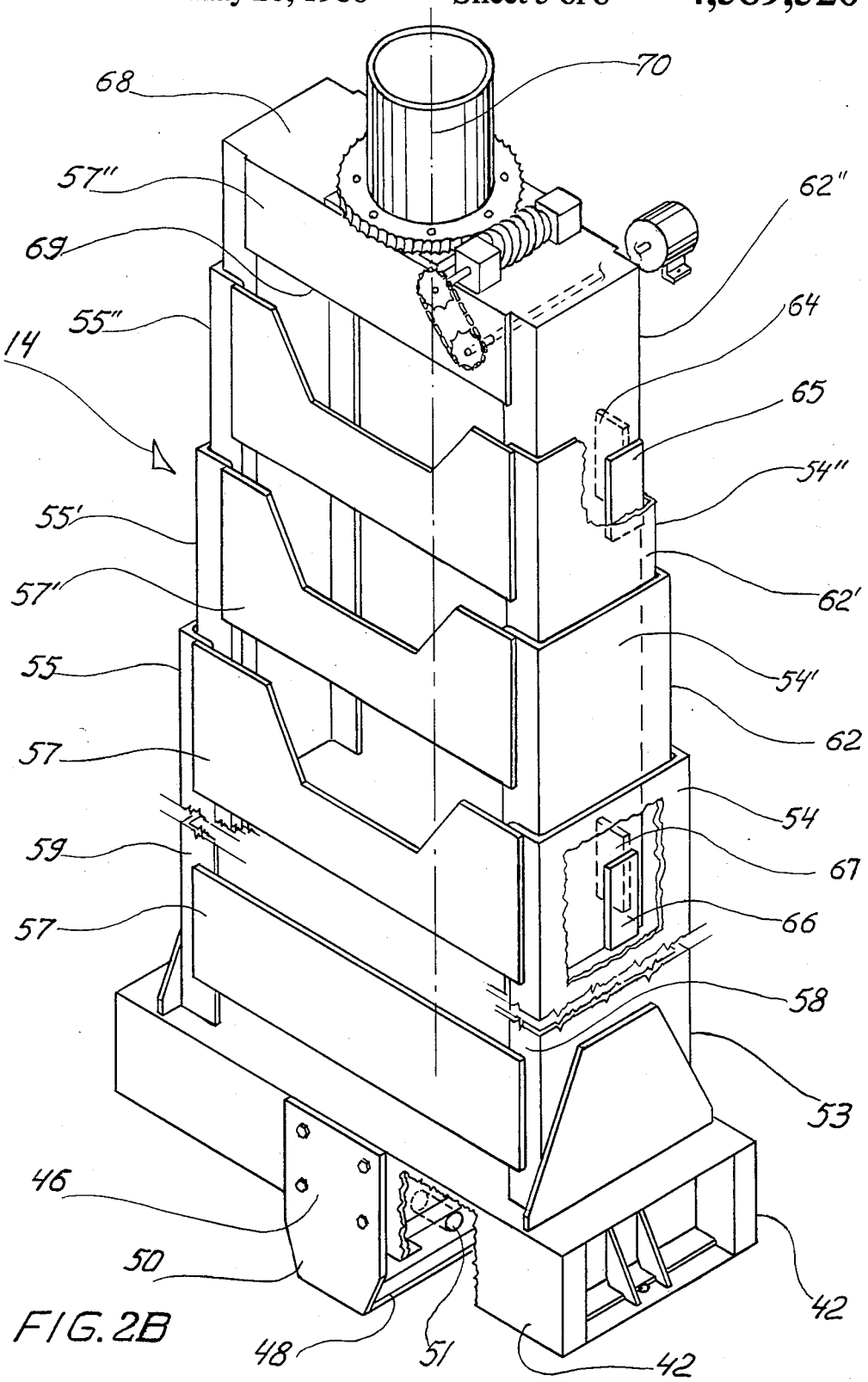
FIG. 2*b* is a representation of the mast in partial extension.

Referring to FIGS. 2*a*, and 2*b*, the truck includes a source of hydraulic fluid under pressure 32, in this best embodiment a pump linked in powered relationship to the engine of the truck 10. At least one fluid interconnection provides fluid communication between the source of hydraulic fluid under pressure 32 and points of fluid consumption mounted upon the truck 10.

The mast 14 includes a pedestal 36 mounted to the chassis 25 and supporting the mast 14 upon the truck 10. The mast pedestal includes support members 38 parallel to and attached to the frame members 27 by suitable or conventional means such as by riveting or bolting. In this best embodiment each support member 38 optionally is buttressed by a rectangularly tubular spacing support 40 attached to the chassis 27 and to the supports 38 by suitable or conventional means such as welding, riveting, or bolting. The tubular spacing supports 40 may perform to reduce flexing and consequent metal fatigue where the frame members 27 are attached to the support members 38, or, as is more usual, may function to provide a clearance between the mast 14 and portions of the truck (not shown) such as a drive line, that would otherwise be in physical interference with the mast. Optionally, cushioning rubber like pads (not shown) may be positioned between the frame members 27 and the cross members 42.

The cross members 42 are arranged to bridge between the frame members 27 and perform to support the mast. At least two cross members 42 are employed in this best embodiment, arranged in parallel bridging relationship between the frame members 27. The cross members 42 are joined by at least one saddle 44, in this best embodiment including end plates 46 and one or more link bars 48, the end plates being fastened to the cross members with portions 50 of the end plates projecting below the cross members 42, the projecting portions 50 being rigidly connected by the link bar 48. The saddle includes a connector 51 such as a link pin assembly or swivel pin assembly.

Alternately, where a sufficient clearance exists beneath upper surfaces 52 of the frame members, the cross members 42 may be mounted directly to the frame members 27, optionally without utilizing the pedestal support members 38 and/or the rectangularly tubular supports 40.

The mast 14 includes a stationary mast or tower section 53 including a pair of opposing channel-like members 54, 55. The stationary mast or tower section is vertically mounted to the cross members 42 by any suitable or conventional method such as by bolting, welding, or riveting and may be supported in the mounting by a suitable backing plate (not shown). The channel-like members 54,55, generally U shaped, are arranged whereby the Us open one towards the other.

A plurality of cross members 57 are attached to pairs of outer surfaces 58,59 of the generally U shaped channel members 54,55 and perform to tie rigidly the channel members 54,55 together in a fixed, spaced relationship. Generally at least 6 cross members 57 are required for tying the channel members, and preferably a pair of cross members is positioned closely adjacent ends of the channel members 54,55, linking each of the pairs of outer surfaces 58,59. The number of cross members 57 utilized in tying the channel members 54, 55 should be sufficient to assure that the channel members do not spread or distort when subjected to torque applied to the mast by virtue of the presence of the platform 12 atop the mast 14 while the mast 14 is extended. By cross members 57, as the term is used hereinafter, what is meant is one or more individual elements necessary to tie a portion of a mast or tower section together rigidly. By reference to a cross member closely adjacent each end of a mast or tower section what is meant is a pair of cross members 57 attached to the pairs of outer surfaces 58,59 of the channel members 54, 55 and rigidly linking these channel members.

The mast 14 includes at least one additional mast or tower telescoping or extendible section 62. The construction of the extendible tower sections is quite similar to that of the stationary section 53, there being two channel-like members 54',55' forming opposing "U"s and linked by crossmembers 57'. The crossmembers 57' should link the channel members 54',55' rigidly against torque applied by virtue of the platform atop the mast 14. One crossmember 57', that is as used herein, a pair of crossmembers should be positioned closely adjacent each end of an extendible tower section 62. The extendible tower section is configured to be received within the stationary tower section in a nesting relationship whereby a dimension taken outside to outside across the generally parallel arms of the U shaped channel members 54',55' of the telescopic tower section 62 is slightly smaller than a corresponding inside dimension taken between the generally parallel arms of the U shaped channel members of the stationary tower section 53.

Additional telescoping tower sections 62' employed in constructing the mast are further nested one within the next in identical fashion until a number sufficient to permit telescoping of the platform to a desired height are incorporated within the mast. A telescoping mast results having an outermost stationary mast or tower section 53, optionally one or more intermediate telescoping mast or tower sections 62, 62' and an innermost telescoping mast or tower section 62", the innermost tower section being extendible to an elevation greater any other mast or tower section, and hereinafter termed the most extendible.

To facilitate telescoping operation of the mast 14, it is desirable that the tower sections 53,62,62',62" be relatively readily slidingly nested. In this best embodiment the channel members 54" include upper wear pads 64, 65 and lower wear pads 66, 67 applied to surfaces of the generally U shaped channel members and optionally including shims. The pads 64, 65 are applied to the inner surface of the U formed by the channel member 54", while the pads 66, 67 are applied to the outer surface of the U formed by the channel member 54". Similar pads are applied to the sections 54, 55, 54', 55', 55" excepting only upper pads are applied to sections 54, 55 and only lower pads are applied to the mast section 62".

The wear pads are affixed to the channels using suitable or conventional retainers (not shown) and are arranged to engage closely surfaces of the adjacent tower section and to provide a surface slidingly suitable for facilitating nesting of the tower sections. Upper and lower wear pads on adjacent mast sections and or the retainers may perform as stops in arresting telescoping motion of the mast tower sections, preventing a tower section from being withdrawn from the next outermost tower section upon extension of the mast.

The most extendible tower section 62" includes a support or top plate 68. The top plate 68 performs not only to tie together rigidly the channel members of the most extendible tower section 62" but also provides a support upon which the platform 12 rests and is supported. In this best embodiment the support plate 68 in comprised of plate material fastened between ends of the opposing channel members by welding or the like. In this best embodiment, the support plate 68 includes a king post 70, generally hollow, which performs to support the platform 12 atop the mast in a pivoting relationship to the mast. Optionally crossmembers 57' adjacent the upper end of the innermost tower section 62" and the support plate 68 may be configured to provide a box like enclosure 69 atop the innermost tower section 62".

Referring to FIGS. *2a* and *4a*, the mast 14 also includes a hydraulic cylinder 72 for telescoping the mast 14 in an upwardly and downwardly direction. The hydraulic cylinder 72 can be of any suitable or conventional type, but in this best embodiment the cylinder 72 is of a double acting nature, that is the cylinder 72 both extends and retracts under the impetus of hydraulic fluid under pressure. Where at least one intermediate tower section 62' is employed in construction of the mast, generally the hydraulic cylinder 72 is of a telescoping configuration having telescoping cylinder sections 74, 74', 74".

In this best embodiment, the cylinder 72 telescopes, with each telescoping or extendible section 74 74' being of approximately the same longitudinal dimension as a corresponding tower section 62,62'. The number of telescoping cylinder sections is preferable equal to the number of telescoping tower sections.

Preferably the cylinder includes a plurality of apertures 75,75',75" on each extendible cylinder section and an attachment point 76 adjacent one end of any suitable configuration. In this best embodiment the attachment point 76 is affixed to a telescoping cylinder section 74 more extendible than any other. The attachment point 76 in this best embodiment is configured to engage the link pin assembly 51 and performs to mount or affix the cylinder 72 adjacent the mounting between the chassis 25 and the stationary tower section 53. Any suitable or conventional mounting between cylinder and the truck 10 may be used, however.

The cylinder 72 also includes an outer shell or barrel 78. The barrel 78 can include a base or attachment tabs 78'. The barrel 78 usually is affixed by means of the tabs 78' to the most extendible telescoping tower section 62", and preferably to the support 68 or the enclosure 69. Attachment of the barrel 78 to the most extendible tower section 62" can be accomplished using suitable or conventional techniques such as welding, riveting, and bolting and may include the use of one or more interconnecting bars of plates in well known manner.

While in this best embodiment, the cylinder 72 is mounted inversely, whereby extension of telescoping sections of the cylinder elevates the barrel 78 of the cylinder with the most extendible tower section, the cylinder alternately may be mounted oppositely. Inverse mounting is preferred as tending to keep debris from accumulating upon seals 79 of the cylinder within which individual sections 74, 74', 74" are slidingly received, thus prolonging the life expectancy of the cylinder and for facilitating sequencing of telescoping motion of the tower sections.

In this best embodiment each telescoping cylinder section 74',74" is mechanically interconnected to a corresponding extendible tower section 62, 62' whereby the corresponding tower section undergoes directed movement only when the interconnected, extendible or telescoping cylinder section is in motion. Referring to FIG. *4b*, an interconnection bracket 80 is provided together with a pair of channel lugs 81. The bracket 80 includes apertures 82 oriented to be alignable with corresponding apertures 75, 75' provided upon the telescoping cylinder sections 74', 74". The lugs 81 are attached by welding, bolting, or the like to the inside of the U of a particular telescoping channel member 62,62', and the brackets are attached to a desired cylinder section 74', 74" using fasteners 83. A particular telescoping cylinder section is thereby tied to a corresponding telescoping mast section during extension and retraction of the mast 14.

Interconnection provides for desirably smooth mast extension and retraction and can be arranged to assure that a particular tower section is elevated where most structurally appropriate. Preferably the innermost telescoping tower section 62" is arranged for extension first so that the platform may be immediately elevated above the remaining, more outer mast sections 53,62,62' for rotation.

Use of a so called double acting cylinder utilizing hydraulic fluid pressure to provide cylinder extension and retraction assures a smoother retraction phase, particularly where, as might be expected, the telescoping tower sections can exhibit a tendency to bind under a torque imposed by the presence of the platform 12 and any platform payload atop the mast.

Figure 3:
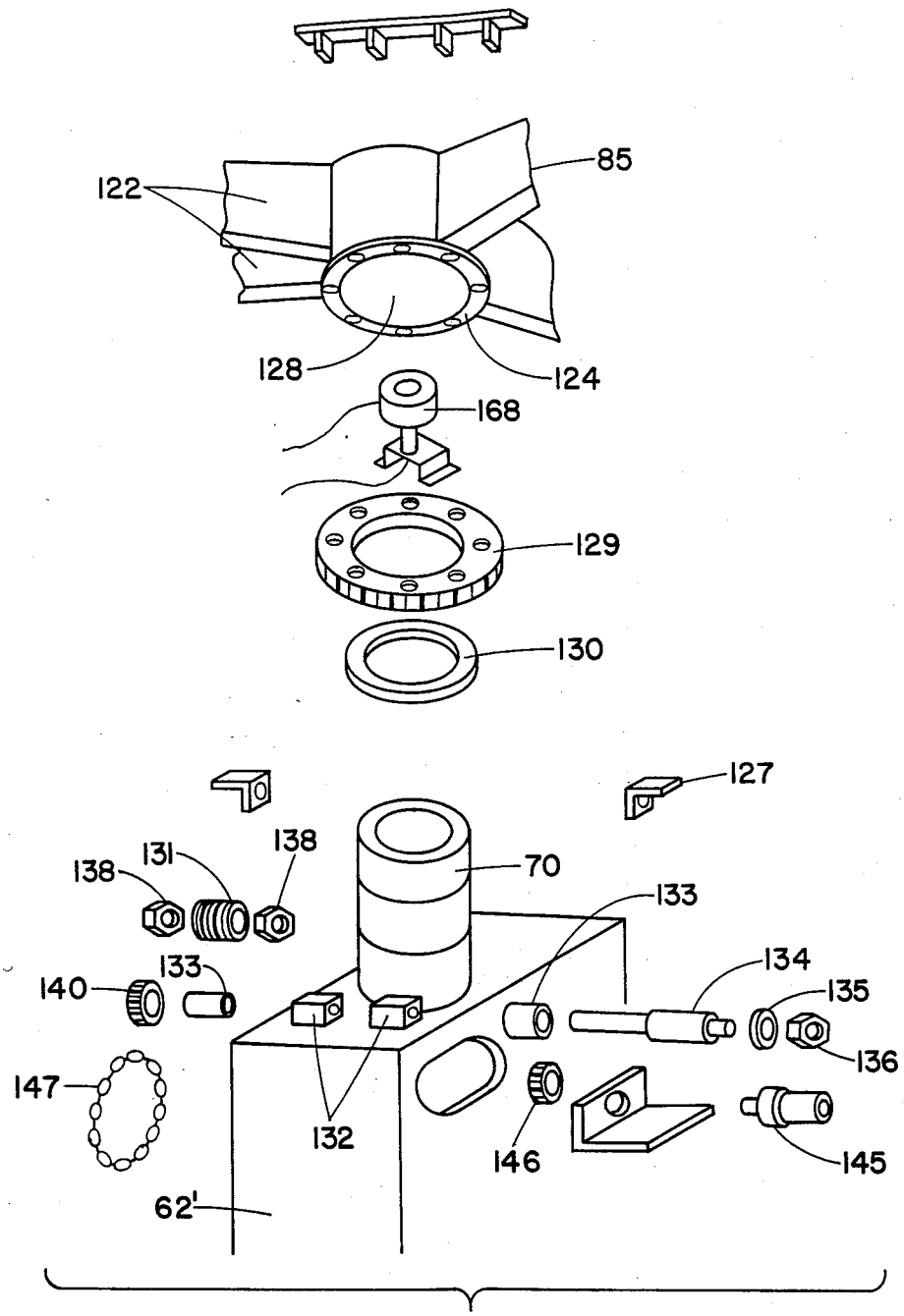
FIG. 3 is an exploded view of a rotational drive means made for rotating a platform on a platform service truck, and its mounting to a mast in accordance with the instant invention.
Figure 4A:
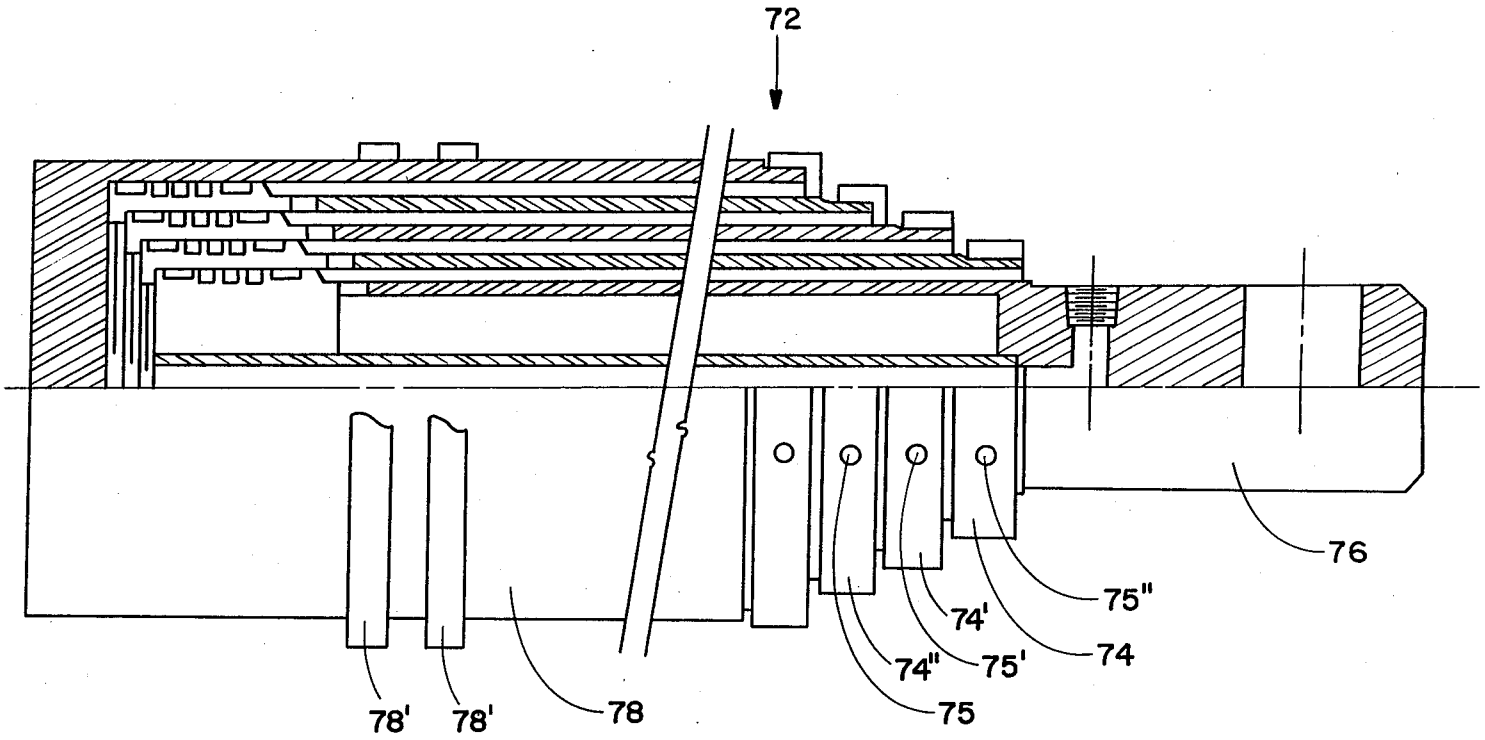
FIG. 4*a* is a partial cross section of a double acting hydraulic cylinder for use in elevating the mast of a platform service truck made in accordance with the instant invention.
Figure 4B:
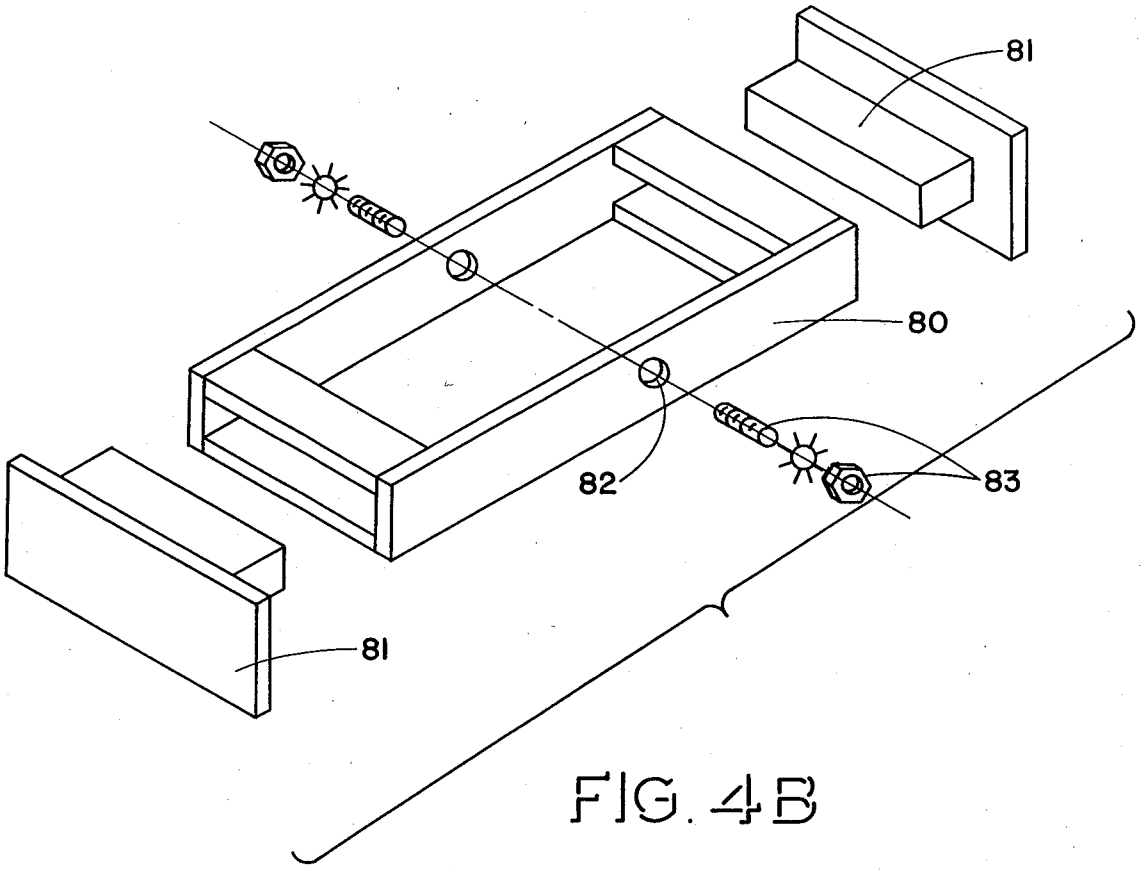
FIG. 4*b* is a representation of a bracket assembly for cross tying cylinder sections with mast sections.
Figure 5:
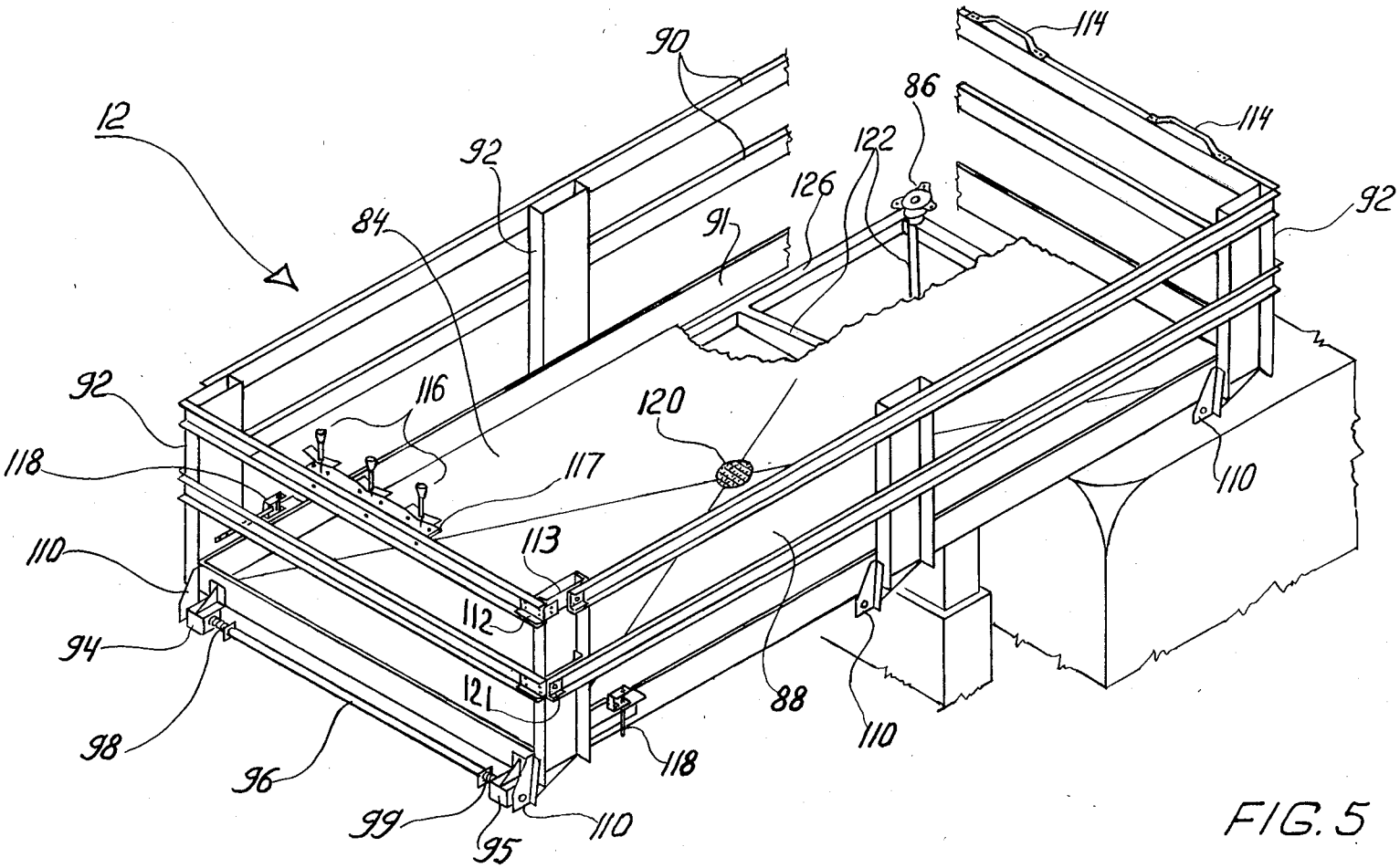
FIG. 5 is an isometric view of a platform for use on a platform service truck in accordance with the instant invention.

Referring to FIGS. 3 and 5, the platform 12 includes an upper base 84 and a platform lower base 85. Electrical insulators 86 are provided between the bases 85, 84 and perform to separate the bases establishing an electrically insulative relationship between the bases and between the upper base 84 and the mast 14, truck 10, and the ground upon which the truck rests.

The extent of the electrical insulative separation can be expressed as a voltage which may be impressed upon the upper base 84 without reaching the lower base 85, truck 10, or ground by flashing over or by leakage to an extent that a worker could interrupt electrical flow and would thereby become injured. The actual electrical insulative properties of the upper base 84 will be in large part a function of the insulative quality of the insulators 86, and the spacing imposed by the insulators between the bases 84, 85. In preferred embodiments the insulators and spacing are capable of providing protection of at least to 500 volts, with the spacing and insulators in this best embodiment being capable of providing protection to 5000 volts. An adequate spacing can be determined according to well known engineering principles; a suitable insulator would be a Petticoat type porcelain insulator having a dry flashover rating of 50 kilovolts (kv), a wet flashover rating of 25 kv., and a leakage distance of 6.3 inches at a temperature of 300° F. The insulators should have a sufficient structural integrity to support the weight of the upper base 84 and any expected working loading to be applied to the upper base.

The upper base 84 includes a working surface 88 and optionally one or more handrails 90 or so called guard rails. Where guard rails 90 are employed, a plurality of posts 92 are provided to which the guard rails are affixed. Preferably, these posts 92 are pivotably affixed to the upper base 84 whereby the posts 92 can be rotated about their attachment to the upper base 84 from a vertical working position to a nearly horizontal position for use when transporting the truck 10 over public highways and/or from one task location to another.

The posts 92 and guard rails 90 can be of any suitable shape and configuration and can be fabricated from any suitable or conventional material. In this best embodiment the posts 92, guard rails 90, and the work surface 88 are fabricated from fiberglas and/or a laminate of wood and fiberglas. Such use of electrically non-conductive fiberglas materials assures against bridging of phases where the platform contacts two or more wires carrying differing electrical phases.

The posts 92 can be pivotably attached to the upper base in any suitable manner. In one preferred method bearing blocks 94, 95 are provided attached to the upper base 84. A pivot tube 96 is provided extending from adjacent one edge of the upper base to an opposing edge, supported by the bearing blocks 94, 95. The pivot tube 96 can include counter balancing springs 98, 99 for assisting in raising and lowering the posts and guard rails in well known manner. Swing down brackets 110 are provided fixedly positioned upon the pivot tube 96 outwardly from where the bearing blocks 94, 95 support the pivot tube 96. The posts 92 are affixed to the swing down brackets 110.

Where the guard rails attach to the posts 92, it is preferable that suitable reinforcers 112, 113 be utilized to assure strength in the connection between the posts 92 and the guard rails 90. The guard rails 90 can be supplied with suitable hand grasps 114, and may include a control station 116 including a mounting bracket 117.

A latch 118 is provided for arresting motion of the handrails 90 from a raised to lowered position, and may be of any suitable or conventional configuration. In a preferred embodiment, the work surface includes a drain 120 to remove accumulations of water and to assist in cleaning the work surface. In this best embodiment, fasteners 121 are utilized for attaching components of the platform 12 one to the next.

The lower base can be of any suitable construction providing an adequate structural support via the insulators for the upper base and any anticipated load thereon. In this best embodiment the lower base comprises a plurality of support arms 122 connecting a central housing 124 with a peripheral frame 126 upon which the insulators 86 are supported. There is no requirement that the central housing be located centrally within the peripheral frame 126, and indeed in this best embodiment it is preferred that the central housing 124 be offset from a physical center of the platform 12 so as to provide a capability for positioning portions of the platform 12 asymmetrically to the truck 10 when in use.

The central housing includes a bearing recess 128 configured to rotatingly receive the king post 70, preferably snugly. To some extent the nature of the bearing recess 128, the king post 70, and snugness of the fit between them will determine the extent of asymmetry that can be accommodated in the positioning of the central housing 124 relative to the platform 12. The platform 12 is thereby mounted to the mast for rotation. Proper configuration of the king post 70 and the recess 128 permit mounting of the platform 12 without further connecting devices, although the use of one or more retainers 127 is preferred.

A ring worm gear 129 is provided, attached to the central housing centerably surrounding the recess. Attachment can be by any suitable or conventional means including welding, riveting, attachment by screws, or bolting. A thrust race 130 is received upon the ring worm gear 129 for supporting vertical thrust imposed upon the ring worm gear 129 by the platform and for assisting in implementation of platform rotation.

In this best embodiment, the platform in driven hydraulicly for rotation. A pair of bearing blocks 132, including bearings or bushings 133 are provided mounted to the support 68 upon the innermost mast or tower section 62″. A worm drive gear shaft 134 is supportably received in the bearing blocks. The shaft is retained using a gear shaft thrust washer 135 and a gear shaft retaining nut 136. A work driving gear 131 is received upon the shaft 134 between the bearing blocks 132 and separated from the bearing blocks by worm driving gear thrust washers 138. A key (not shown) performs to join the shaft 134 and the worm driving gear 131 for rotation. A worm driving gear sprocket 140 is provided upon the shaft 134.

A reversible hydraulic motor 145 is provided affixed to the innermost telescoping tower section 62″. The motor 145 includes a chain sprocket 146. A chain 147 is provided connecting the chain sprocket 146 and the worm driving gear sprocket 140 in driving relationship. The hydraulic motor and the worm driving gear are thereby connected in a reversible driving relationship.

The worm driving gear is positioned to engage the ring worm gear 129 in driving relationship whereby the platform 12 may be rotated in either clockwise or counterclockwise direction in a horizontal plane about the mast 14.

Other suitable or conventional machine powered means for rotatingly driving the platform in both a clockwise and counterclockwise direction continuously about the mast may be utilized. By continuously what is meant is that rotation of the platform about the mast should continuous throughout 360° and not interrupted at some point requiring reversal of the platform rotation for reaching some rotational positions. For purposes of the instant invention any hydraulic drive means rotatingly interconnecting the platform and the innermost tower section for rotation of the platform can be utilized.

The worm drive gear mechanism of this best embodiment provides a driving mechanism that self locks when not powered for rotation. This self locking feature is important in that use of the truck 10 on sloped surfaces is thereby permitted with the platform rotated to any position without operator fear of an unexpected rotation of the platform away from a desired position. Any other suitable mechanism used for driving the platform 12 rotatingly should preferably be self locking in an essentially infinite number of platform rotational positions while the rotational mechanism is not under power. Most preferably this self locking feature should be automatic in nature, requiring no operator action for implementation.

Figure 6:
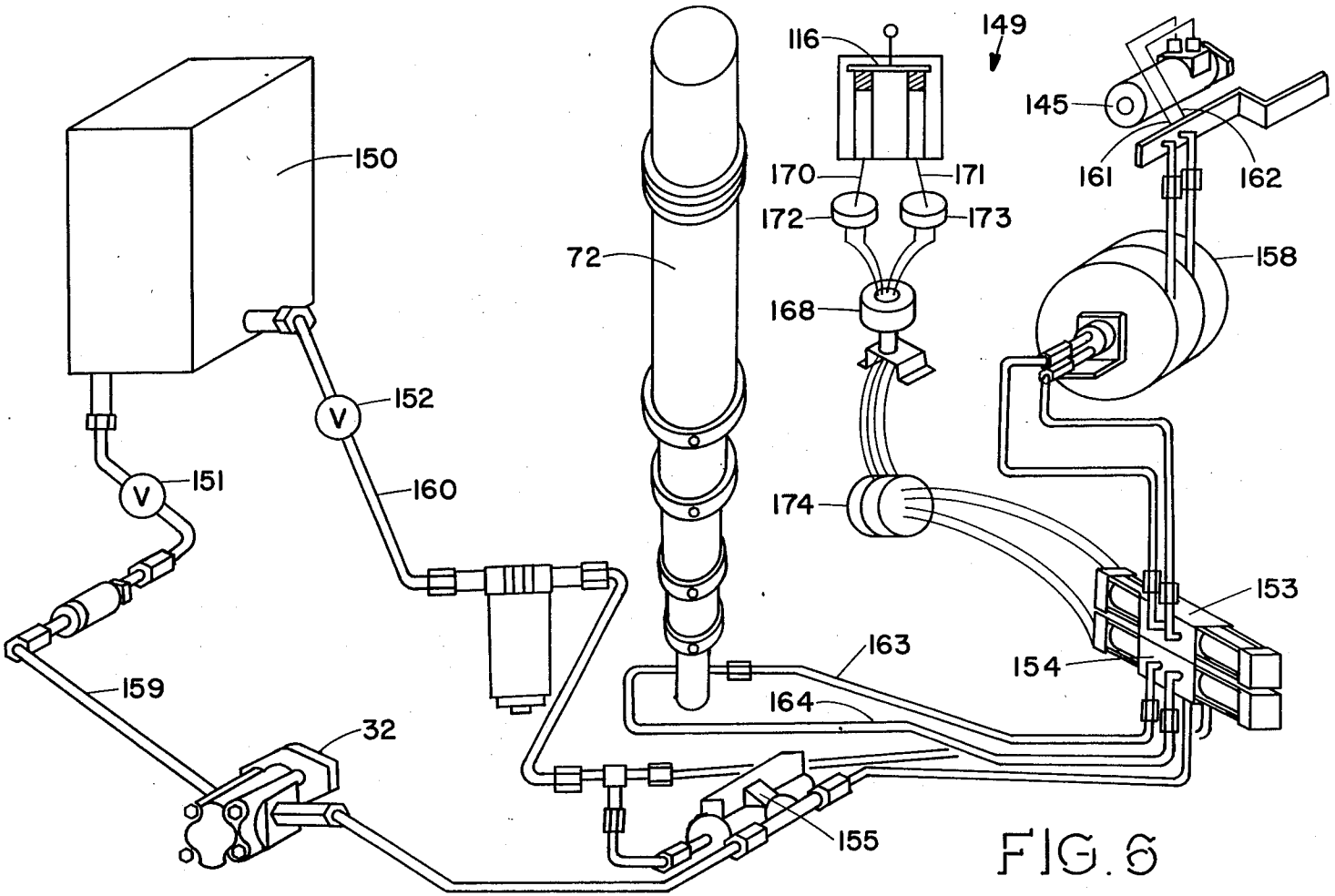
FIG. 6 is a schematic view of a control scheme for use on the platform service truck of the instant invention.

Referring to FIG. 6, a schematic of a typical control system 149 is shown for use with the platform truck of the instant invention. The control system 149 of this preferred embodiment operates hydraulically and includes a reservoir 150 containing hydraulic fluid for use in the control system 149. The reservoir 150 includes valves, 151,152 for manually isolating the reservoir 150 from the control system 149 during servicing. The source of hydraulic fluid under pressure, in this best embodiment a pump 32, draws fluid from the reservoir 150 and supplied the fluid under pressure to a rotational solinoid control valve 153 and a cylinder solinoid control valve 154 controllable by an operator using levers or a set of electrical controls (not shown). Generally any such electrical controls preferably operate upon 12 or 24 volts direct current (D.C.) utilizing the electrical generating/storage capability of the truck 10. A relief valve 155 is generally included in the control schematic to provide a limitation upon the hydraulic pressure than can be achieved in the control system. The valve 153 is utilized to provide hydraulic fluid under pressure to the rotational drive means, in this best embodiment a hydraulic motor 145. A hose reel 158 can be employed to supply the hydraulic fluid to the motor 145. Supply 159 and return 160 hydraulic lines are provided for conducting hydraulic fluid to and from the reservoir 150.

Fluid is directed to the hydraulic motor 145 through hydraulic hoses 161,162. Depending upon which hose 161,162 receives fluid under pressure from the solinoid valve 153, the platform 12 will be rotated either in a clockwise or counterclockwise direction. Similarly, hydraulic hoses 163,164 are provided for carrying hydraulic fluid under pressure to the hydraulic cylinder 72. Depending upon the hose 163,164 through which hydraulic fluid under pressure is directed using the solinoid valve 154, the cylinder can be caused to either telescope or collapse for raising and lowering the mast 14.

Referring to FIG. 3, a rotating coupling 168 is provided for connecting controls that may be mounted upon the platform 12 with the solinoid valves 153, 154. This rotating coupling 168 can be of any suitable or conventional nature as are well known, and performs to transfer electrical signals generated using the controls 116 mounted upon the platform 12 to the solinoids 153, 154 through the rotational interface between the platform 12 and the mast 14.

Preferably, control signals from the platform originate as a fluid, pneumatic of hydraulic signal available from a rocking type control valve 116 which fluid signals are conducted through non electrically conducting tubes 170, 171 to fluid to electric converters 172, 173 for transmission via the rotating connector 168 to the solinoids 153, 154. An electrical wire reel 174 facilitates the transfer. The converters 172, 173 are mounted below the upper platform base. Use of pneumatic control signals from the platform 12 assists in maintaining the electrical insulative properties of the platform making it a safe work platform.

In certain preferred embodiments, the pump 32 is powered by the engine of the truck 10 using a power takeoff (PTO, not shown) or other suitable powering means. Where the use of a PTO is contemplated, it may be desirable that the engine be arranged so that as hydraulic fluid is directed to, for example, the cylinder 72 using the solinoid 154, the engine can be speeded up to provide a larger volume of hydraulic fluid under pressure from the pump 32. Where controls on the truck are electrically activated at least in part, speedup of the engine can be accomplished in a manner well known to those skilled in the art of PTOs.

In preferred embodiments the mast 14 is cross tied for support to the body 23 of the truck 10. Generally the cross ties 180 are attached to the stationary mast section 53 using conventional techniques such as welding or bolting. The cross ties are then attached to the body 23 using similar techniques. Cross tying provides additional support for the mast when extended.

From time to time it may be desirable to employ one or more jacks (not shown) attached to the truck 10, generally at the pedestal 36 for supporting the truck 10 against tipping while the mast is extended. Such jacks can be of any suitable or conventional nature or well known type. Hydraulic fluid under pressure from the pump 32 can be employed for operating the jacks.

While the use of hydraulic fluid under pressure to rotate the platform and elevate the cylinder has been shown, other suitable sources of motive power can be employed such as pneumatics.

While a preferred embodiment of the invention has been shown and described in detail, it should be apparent that various modifications and/or alterations may be made thereto without departing from the scope of the claims that follow.

What is claimed is:

1. In a platform type service truck suitable for use upon and travel along public highways; the truck having a chassis including parallel frame members for supporting truck portions including a cab mounted upon the chassis, an engine and drive train for powering the truck, at least one powered source of hydraulic fluid under pressure for operating hydraulic devices mounted on the truck, and a work platform mounted to the frame members and capable of being telescopingly elevated from a lowered position for transporting the truck along public roadways to at least one elevated working position, the improvement comprising:

a stationary telescopic tower section mounted atop the frame members, the stationary section including two opposing channel-like vertical members joined by at least three cross members, a cross member being positioned closely adjacent each end of the stationary telescopic tower section;

at least one extendible telescopic tower section including opposing channel-like vertical members joined by at least three cross members, a crossmember being positioned closely adjacent each end of the extendible telescopic tower section, the extendible section being slidingly nested within the stationary section, and additional extendible sections being slidingly nested one within the next whereby the stationary section is outermost and an extendible section capable of being more elevated than any other section is innermost within the nest the more elevatable extendible section having a closed upper end forming a support plate and having a king post mounted to the support plate upwardly from the support plate;

elevational stops between each telescoping tower section and the next innermost telescoping tower section positioned to prevent a telescoping tower section from being elevatably withdrawn from the nest, the elevational stops being configured as sliding pads for facilitating sliding between adjacent sections;

a double acting hydraulic cylinder having a barrel including attachment tabs, and a number of telescopic extendible portions, including a most extendible having an attachment point, equalling the number of extendible telescopic tower sections, each telescopic extendible cylinder portion being attached to a corresponding tower section whereby longitudinal movement of the cylinder portions positively and correspondingly longitudinally moves the nested tower sections, the double acting hydraulic cylinder being affixed by its attachment point adjacent the mounting between frame members and stationary tower section and by its barrel to the support plate obversly from the king post, the cylinder including fluid interconnections to the source of hydraulic fluid;

a platform rotatable in a horizontal plane, including safety rails and a work surface, the platform having an upper base to which the safety rails and work surface are attached, and a lower base, the platform bases being separated by insulators and by spacing with the separation being rated for at least 500 volts, the platform lower base including a circular recess configured to receive the king post snugly, and a ring worm gear affixed to the lower base centerably surrounding the recess;

a platform rotational drive, the rotational drive including a worm drive gear having a hydraulically driven motor affixed to the support plate and engaging the ring worm gear, the engagement being self locking while the drive gear is not under power regardless of rotational position of the platform, and a hydraulically driven motor including fluid interconnections to the source of hydraulic fluid for powering the worm drive gear in either direction; and at least one set of controls for regulating the flow of hydraulic fluid under pressure separately to the cylinder and the hydraulically driven worm gear drive motor, any controls mounted above the lower platform base being interconnected in a manner preserving the electrical insulative integrity of the platform.

2. The platform service truck of claim 1, the work surface and safety rails being fabricated from at least one of fiberglas and fiberglas-wood laminates.

3. The platform service truck of claim 1, the insulators being rated for at least 5000 volts.

4. The platform service truck of claim 1, the controls being electrical and at a minimum operating valves restricting hydraulic fluid flow in fluid interconnections providing hydraulic fluid to the cylinder and the hydraulically driven worm gear drive motor, but controls mounted above the platform lower base being of a type providing a fluid pulse delivered via non electrically conductive tubing to a fluid to electrical signal converter mounted at least below the insulators, any control signal from the platform being transmitted to any point below the platform lower base via a rotating coupling mounted in relatively close proximity to the recess.

5. The platform service truck of claim 1, the platform being rotatable at a speed of up to 3 revolutions per minute.

6. The platform service truck of claim 1, the safety rails being hingedly foldable to a position closely adjacent the work surface for transporting the truck along public highways.

7. The platform service truck of claim 1, the stationary tower section also being attached to the truck at a point above the mounting between the stationary tower section and the frame members.

* * * * *